United States Patent [19]

Bell

[11] 4,069,414

[45] Jan. 17, 1978

[54] FIREARM SIGHT LIGHT

[76] Inventor: Arthur O. Bell, 510 E. Wyatt, Herington, Kans. 67449

[21] Appl. No.: 692,896

[22] Filed: June 4, 1976

[51] Int. Cl.[2] ..... F21V 33/00

[52] U.S. Cl. ..... 362/110; 42/1 S

[58] Field of Search ..... 240/2 F, 2 R, 6.41, 240/11.2 R, 52 R; 42/1 A, 1 S

[56] References Cited

U.S. PATENT DOCUMENTS

| | | | |
|---|---|---|---|
| 1,080,795 | 12/1913 | Ward | 240/6.41 |
| 1,579,671 | 4/1926 | Staats-Oels | 240/6.41 |
| 2,329,864 | 9/1943 | Thomas | 240/6.41 |
| 4,000,403 | 12/1976 | Rice | 240/2 F |

*Primary Examiner*—Richard L. Moses

[57] ABSTRACT

This device consists primarily of a light and lens arrangement, secured within a bracket mounted to the receiver of a rifle, or other firearm; the device projects a beam of light in alignment with the front sight of the firearm, and the bracket means is secured by screw fastener means to the receiver of the firearm, and to the bracket is secured a phone jack, which removably receives a male phone jack, attached by wire means to a battery having switch means secured thereon, so as to provide a power source for the sight light.

2 Claims, 5 Drawing Figures

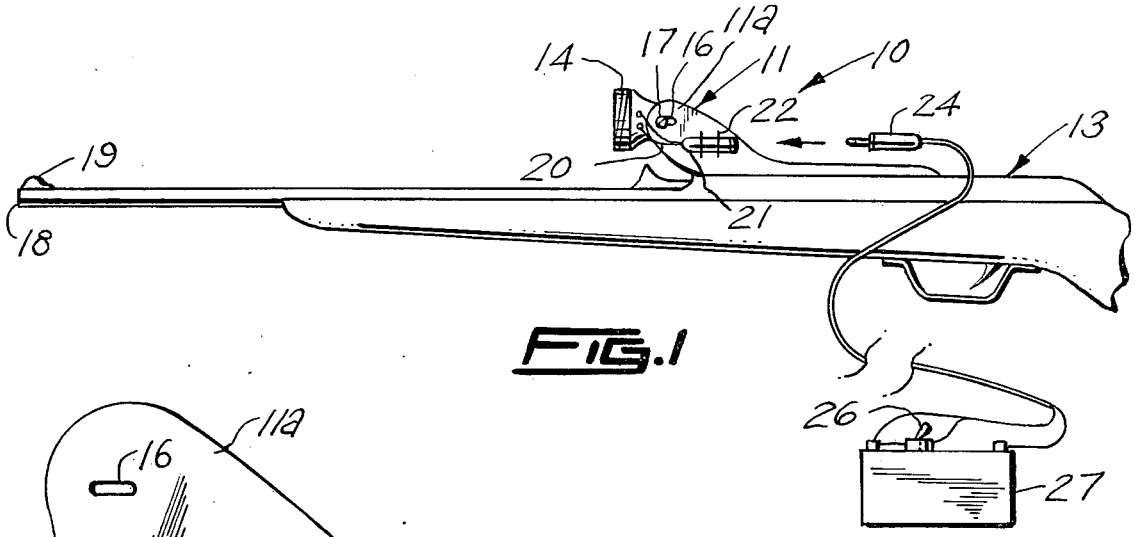
FIG. 1
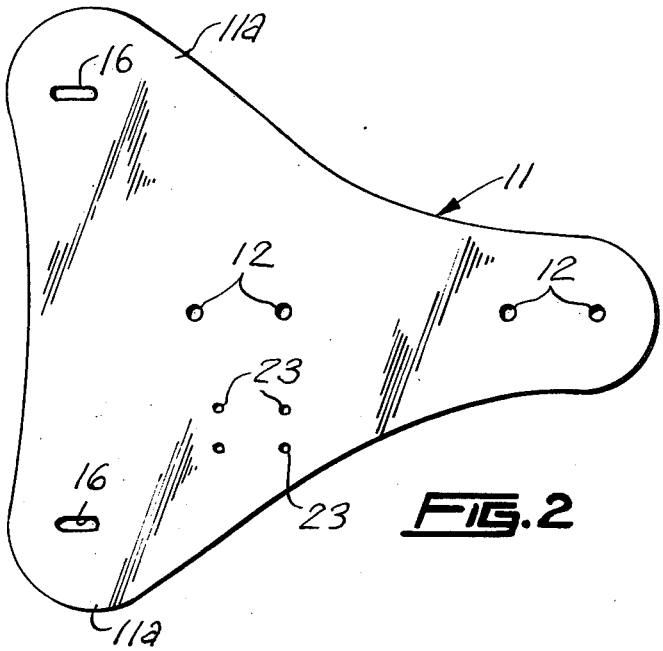
FIG. 2
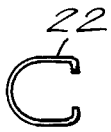
FIG. 4
FIG. 3
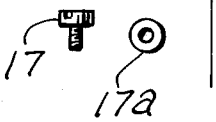
FIG. 5
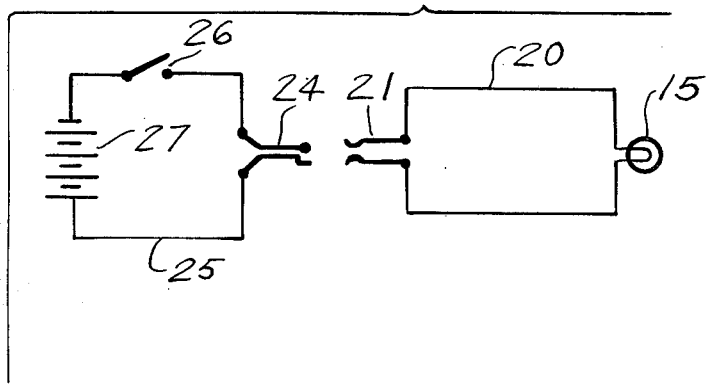

FIREARM SIGHT LIGHT

This invention relates to hunting accessories, and more particularly to a firearm sight light.

It is, therefore, the principal object of this invention to provide a firearm sight light which will be particularly adaptable for firearms, so as to effectively hunt racoon at night.

Another object of this invention is to provide a firearm sight light, which will be mounted in bracket means on the receiver of a firearm, with the lens positioned immediately towards the muzzle of the firearm, so as to illuminate the front sight and not the rear sight.

A further object of this invention is to provide a sight light of the type described, which will enable the user to aim the rifle, by looking between the bracket beneath the light housing thereof.

A still further object of this invention is to provide a sight light, of the type described, which may be attached to any rifle having a tapped receiver, and with slight modifications, the bracket thereof may be attached to a rifle having a grooved receiver. The present invention is of such structure, that it can remain on the rifle, or it may be disconnected from the power source by use of a phone jack.

Other objects of the invention are to provide a firearm sight light for hunters which is simple in design, inexpensive to manufacture, rugged in construction, easy to use and efficient in operation.

These and other objects will be readily evident upon a study of the following specification and the accompanying drawing, wherein:

FIG. 1 is a side view of the present invention, shown secured to a rifle which is shown fragmentary and in elevation, the male plug being shown separated from the female plug of the device;

FIG. 2 is a plan view of the bracket of the device shown prior to forming and mounting the light and female plug jack;

FIG. 3 is a plan view of one of the light mounting screws and rubber washers of the device;

FIG. 4 is a plan view of one of the female plug jack mounting clips for the bracket of the device;

FIG. 5 is a schematic wiring diagram of the invention.

According to this invention a firearm sight light 10 is shown to include a bracket 11 formed into a "U" shape. Bracket 11 is provided with a plurality of spaced apart openings 12 so as to be mounted to the receiver portion of the rifle 13. A housing 14 of standard construction is provided with a bulb 15 and a reflector, and a pair of spaced apart and elongated openings 16, one each, through the ear portions **11*a* of bracket 11 provide a means of securing housing 14 to bracket 11 through the use of a pair of screw fasteners 17 with rubber washers 17*a*. The housing 14 having the bulb 15 therein faces towards the muzzle 18 of rifle 13 so as to sight on the front sight 19** and the target.

It shall be noted that the user sights between the ears **11*a* of bracket 11 beneath the light housing 14**.

A pair of wires 20 are secured in series with bulb 15 and the female phone jack 21. Jack 21 is held fixedly secured to one side of bracket 11 by means of a pair of spaced apart clips 22, the ends of which are received within the spaced apart openings 23 of bracket 11. The removable male phone jack 24 is electrically secured in series with wires 25 to switch 26 and battery 27 which is carried upon the belt of the hunter using device 10.

It shall also be noted that the housing 14 contains bulb 15, which is adjustable within bracket 11 by means of the screw fasteners 17.

What I now claim is:

1. A device for illuminating a target and the front sight of a rifle having conventional open sights and a tapped receiver, comprising: an electric lamp; a U-shaped sheet metal bracket having a pair of lateral protruding ears bent upward to a vertical position with an elongated portion extending out from the base thereof and perpendicular to said ears, said elongated portion forming a located above and parallel to the bore of the rifle supporting said lamp when properly mounted on the receiver with external power supplied through a phone jack attached to said bracket, said bracket having drilled holes properly spaced to coincide with holes in the receiver normally used for mounting a bracket to accommodate a telescopic sight, four drilled holes for wire fasteners to hold said female phone jack securely, and two elongated holes in said vertical ears of said bracket for bolts that support said light and allow adjustment of said light on a horizontal plane, said electric lamp mounted in said bracket by means of bolts with neoprene washers to prevent oscillation but allow adjustment in a vertical plane, said lamp comprised of a case to hold a lens, reflector, a bulb connected electrically through said phone jack, electrical cord, a toggle switch that is mounted physically and electrically to a six volt dry cell battery mounted on the user's belt, said lamp being mounted a sufficient distance above the front and rear sights to allow sighting on the target in a normal manner.

2. The lowest extremity of the light case described in claim 1, when mounted on the rifle, is situated three eights inch above the line of sight and the front of said case is situated one half inch from the rear sight toward the muzzle of the rifle.

* * * * *